US008658901B2

(12) United States Patent
Schloms et al.

(10) Patent No.: US 8,658,901 B2
(45) Date of Patent: Feb. 25, 2014

(54) MOTOR VEHICLE CONDUCTOR CONNECTION ELEMENT

(75) Inventors: Martin Schloms, Aachen (DE); Sebastian Martens, Viersen (DE); Franz-Josef Lietz, Overhausen-Lirich (DE)

(73) Assignee: Auto Kabel Managementgesellschaft mbH, Hausen i.W. (DE)

( * ) Notice: Subject to any disclaimer, the term of this patent is extended or adjusted under 35 U.S.C. 154(b) by 407 days.

(21) Appl. No.: 13/002,871

(22) PCT Filed: May 8, 2009

(86) PCT No.: PCT/EP2009/055605

§ 371 (c)(1),
(2), (4) Date: Jan. 6, 2011

(87) PCT Pub. No.: WO2010/012515

PCT Pub. Date: Feb. 4, 2010

(65) Prior Publication Data

US 2011/0114363 A1 May 19, 2011

(30) Foreign Application Priority Data

Aug. 1, 2008 (DE) ..... 10 2008 035 863

(51) Int. Cl.
*H01B 7/08* (2006.01)

(52) U.S. Cl.
USPC ..... 174/117 F; 29/857; 29/827

(58) Field of Classification Search
USPC ..... 174/117 F; 29/827
See application file for complete search history.

(56) References Cited

U.S. PATENT DOCUMENTS

| | | | | | |
|---|---|---|---|---|---|
| 2,939,905 | A | * | 6/1960 | Canfield | 174/71 R |
| 2,961,762 | A | * | 11/1960 | Clark et al. | 228/170 |
| 3,468,015 | A | * | 9/1969 | Santala | 228/160 |
| 3,535,781 | A | * | 10/1970 | Comey, Jr | 29/882 |
| 3,754,318 | A | * | 8/1973 | Trost | 29/460 |
| 3,990,864 | A | | 11/1976 | Rozmus | 29/630 C |
| 4,125,936 | A | * | 11/1978 | Rozmus | 29/879 |
| 4,315,175 | A | | 2/1982 | Hamilton et al. | 310/71 |

FOREIGN PATENT DOCUMENTS

| | | | |
|---|---|---|---|
| DE | 1010600 | 6/1957 | H01R 4/62 |
| DE | 1228688 | 11/1966 | H01R 4/62 |
| DE | 6805105 | 5/1969 | H01R 4/00 |
| DE | 102006031839 | 1/2008 | H01R 43/16 |
| DE | 10 2006 050 708 | 5/2008 | H01R 11/28 |
| EP | 1 514 634 | 3/2005 | B23K 26/32 |
| GB | 2 252 569 | 8/1992 | C23C 4/08 |

OTHER PUBLICATIONS

German Patent Office, In German—Office Action, Application No. 102008035863.0-34, dated Jun. 3, 2009, 5 pages.

(Continued)

*Primary Examiner* — William H Mayo, III
*Assistant Examiner* — Hiram E Gonzalez
(74) *Attorney, Agent, or Firm* — Sunstein Kann Murphy & Timbers LLP

(57) ABSTRACT

Motor vehicle conductor connection element includes a first flat part and an inlay arranged in the flat part so as to be substantially flush with a surface of the flat part. In order to ensure contacting with different conductors, the flat part is substantially coated with a metal and the inlay is partially coated with the metal.

16 Claims, 2 Drawing Sheets

(56) References Cited

OTHER PUBLICATIONS

German Patent Office, English translation—Office Action, Application No. 102008035863.0-34, dated Jun. 3, 2009, 6 pages.

European Patent Office,—International Search Report and The Written Opinion of the International Searching Authority—Appl. No. PCT/EP2009/055605, dated Aug. 27, 2009 (11 pages).

European Patent Office, English Translation of International Search Report—Appl. No. PCT/EP2009/055605, dated Aug. 27, 2009 (3 pages).

State Intellectual Property Office of P.R.C., In Chinese—Office Action, Application No. 200980130103.7, dated Jul. 4, 2013, 6 pages.

State Intellectual Property Office of P.R.C., English translation—Office Action, Application No. 200980130103.7, dated Jul. 4, 2013, 8 pages.

* cited by examiner

MOTOR VEHICLE CONDUCTOR CONNECTION ELEMENT

The application relates to a motor vehicle conductor connection element and to a method for producing such a motor vehicle conductor connection element.

Motor vehicle conductors in cars and trucks are nowadays increasingly being produced from aluminium. It has been found that the current carrying capacity of aluminium is suitable for high currents. Furthermore, it entails fewer weight problems in the case of a large conductor cross-section.

However, it is known that an aluminium oxide layer forms on the surface of aluminium due to environmental influences. This aluminium oxide layer is a poor conductor and thus represents a high transfer resistance for connection technology. If the aluminium conductors are connected to other conductors, for example cable shoes made from copper, the aluminium oxide layer must first be broken up in order to establish an electrical contact with low transfer resistance. At the same time, when using different metals, for example aluminium and copper or other non-ferrous metals, the interface must be protected against environmental influences. Otherwise corrosion occurs in the region of the interface and the contact may be impaired.

In order to be better able to establish electrical connections between an aluminium conductor and conductors made from other metals, for example copper, connecting lugs which are made from different metals are known. By way of example, the German patent application DE 10 2006 031 839.0 discloses an electrical contact element which serves for contacting aluminium flat conductors to round conductors. In this case, a first part of the contact element is formed of aluminium and a second part is formed of copper. The interface between the aluminium and the copper is protected against corrosion by being overmoulded. However, such a contact element is difficult to produce.

For this reason, the object of the application was to provide a contact element which has good electrical properties and which at the same time can be produced easily and inexpensively.

According to one subject matter, this object is achieved by a motor vehicle conductor connection element comprising a first flat part and an inlay arranged in the flat part so as to be substantially flush with a surface of the flat part, wherein the flat part is substantially completely coated with a metal and the inlay is partially coated with the metal.

It has been found that an inlay which is substantially flush with a surface of the flat part can be incorporated directly in the flat part. If the entire motor vehicle conductor is then coated and part of the inlay is left out, then it is possible to produce a motor vehicle conductor connection element in which the interface between the inlay and the flat part is substantially coated with metal. This metal coating protects the interface between the inlay and the flat part against corrosion. In addition, it is possible to produce the flat part and the inlay from different metals in order to be able to achieve good contact conditions with conductors made from different metals. By coating the inlay only partially, at least part of the inlay is free of metal coating and it is possible to contact a conductor or a connecting bolt directly with the uncoated part of the inlay.

The conductor may be for example an energy conductor, which must have a high current carrying capacity and a cross-section of more than 10 $mm^2$, preferably more than 100 $mm^2$. The conductor may also be used as a current conductor in on-board power supplies and may serve as a signal conductor.

The coating may take place by means of electroplating processes. More than one layer may also be applied.

According to one advantageous example of embodiment, it is proposed that the inlay is coated with the metal in the region of an interface with the flat part. If the inlay is arranged flush in the flat part, an interface forms between the material of the inlay and the material of the flat part. This interface is susceptible to the ingress of ambient moisture and thus to corrosion. In order to prevent any ingress of ambient moisture, the interface is coated with the metal. The metal thus surrounds the flat part together with the interface, and part of the inlay remains free of metal coating.

For this reason, it is proposed according to one advantageous embodiment that the inlay is free of the metal coating in a central region remote from the interface with the flat part.

On the one hand it is possible to connect a conductor composed of aluminium strands to the flat part when the inlay is made from aluminium. The flat part may then be made for example from copper. A copper cable can easily be connected to the copper of the flat part.

On the other hand, for connection to aluminium flat conductors, it is proposed that the flat part is formed substantially of aluminium. In this case, the inlay may be made from copper. A copper cable can then be attached to the inlay.

In order to be able to establish a contact with a copper wire for example, it is proposed that the inlay is formed of a non-ferrous metal or alloys thereof, in particular copper, zinc, tin, bronze or brass. The part of the inlay that is free of the metal coating may be used for example to establish a contact with a copper round conductor. In particular, it is advantageous if the inlay is made from copper if a contact is to be established with a conductor made from copper. The metal coating may be formed of tin, nickel or similar metals. The metal coating may be applied by means of electroplating processes.

On the other hand, a contact can also be established between a copper flat part and an aluminium line. In this case, it is proposed that the inlay is made from aluminium or an alloy thereof. The part of the inlay that is free of the metal coating may be used for example to establish a contact with an aluminium conductor, for example a round conductor. The flat part may be formed of copper and may serve as a connecting lug for a connection to a further conductor, for example likewise made from copper. The metal coating may be formed of tin, nickel or similar metals. The metal coating may be applied by means of electroplating processes.

In order to arrange the inlay flush with a surface of the flat part, it is proposed that a groove is arranged in the flat part. The inlay can be arranged in this groove with a material and/or force fit. It is possible to arrange the inlay with a press fit in the groove of the flat part, or to weld it into the groove.

According to one advantageous embodiment, it is proposed that the inlay is pressed or rolled into the flat part. In the case of rolling, it is possible for example that the inlay is placed as a strip onto a somewhat broader strip from which the flat part is produced, and then is mechanically pressed into the flat part.

According to one advantageous embodiment, it is proposed that the flat part together with the inlay is produced from a strip extending in the longitudinal direction with the inlay arranged in the longitudinal direction. The flat part may be produced from a strip, for example an aluminium strip or a copper strip. By way of example, the strip may have a width of 1 cm to 20 cm and may be unwound from a coil. The inlay, for example likewise as a strip, is then laid in a longitudinal direction in one region of the flat part and in a final step is mechanically, physically or chemically bonded to the flat part in such a way that the surfaces of the inlay and of the flat part are flush. In a further operating step, the flat part can be at least partially cut from the resulting strip which is provided in the longitudinal direction with a strip representing the inlay, said flat part then serving as the motor vehicle conductor connection element. During the punching, the strip may serve as a carrying strap for the punched parts. The partially punched parts can thus be supplied for further processing as goods being strapped.

It is also proposed that the flat part together with the inlay is punched from the strip. By virtue of the punching, the flat conductor together with the inlay can be produced as loose materials.

According to one advantageous embodiment, the motor vehicle conductor connection element may be formed of the flat part and the inlay and may serve as a connecting lug. The connecting lug may for example be shaped in such a way that a conductor, for example aluminium, is connected to the motor vehicle conductor connection element in the region of the inlay by means of ultrasonic welding, soldering or other connection techniques for forming a material-to-material connection. On the other side, the connecting lug may serve for likewise being connected material-to-material with an electrical conductor. In this case the flat part, which is formed for example of copper, may serve for being connected to a copper conductor by means of ultrasonic welding, rotary friction welding, multi-orbital friction welding or other welding processes. A screwing at a bolt, for example into a housing of a fuse box or junction box, is also possible.

It is also possible to form the inlay of copper and the flat part of aluminium. In this case, a copper conductor can be connected to the inlay and the flat part formed of aluminium can be connected to an aluminium conductor by means of welding processes.

According to one advantageous embodiment, it is proposed that the connecting lug has a connection for a bolt. This may be for example a bore into which a bolt can be inserted and/or screwed. The bolt may serve for example as a connecting pin for a soldered connection, or for screwing to a connection terminal.

Another subject matter of the application is a method for producing a motor vehicle conductor connection element, which is characterised in that a strip is equipped with an inlay extending flush with the surface along the longitudinal axis of the strip, in that a flat part is cut from the strip together with the inlay, and in that the flat part is substantially completely coated with a metal, the inlay being partially coated with the metal. A strip is first equipped with an inlay extending in the longitudinal direction of the strip. The inlay is connected to the strip in such a way that the surface of the inlay is flush with a surface of the flat part. The flat part together with the inlay can then be coated with metal, part of the inlay being left out of the coating process.

When the flat part is cut from the strip, a partial cutting may also take place. The strip may then serve as a strap between individual flat parts. The flat part may be detached from the strip at least along three sides, and a predetermined breaking point may be pre-punched on a fourth side. The flat part can then be detached from the strip at this predetermined breaking point in a further processing step. For the further processing, however, the flat part is initially still attached to the strip and can be further processed as an item being a strapped.

In order to protect the interface between the flat part and the inlay against corrosion, it is proposed that the inlay is coated with the metal in the region of an interface with the flat part.

In order to ensure that a good contact with electrical conductors, for example made from copper or aluminium, is possible via the inlay, it is proposed that the inlay is not coated with the metal in a central region remote from the interface with the flat part. Depending on whether a copper line or an aluminium line is attached to the inlay, the inlay may be formed either of copper or of aluminium. Other non-ferrous metals except copper may also be used, as well as aluminium alloys.

In order to produce the motor vehicle conductor connection element, it is proposed according to one embodiment that the strip equipped with the inlay is first partially covered with a protective element and then the flat part is coated with the metal. The protective element may be for example an adhesive film or some other film-like coating which covers the inlay in its central region. The inlay may also be coated/covered with a cover, a stopper, e.g. made from rubber, or a varnish during the coating operation. The protective element may likewise extend along the longitudinal axis of the strip during the production process and thus may partially cover the inlay in a continuous process.

According to one advantageous example of embodiment, it is proposed that the flat part is cut from the strip after the step of covering the strip with the protective element. Said cutting may take place for example by punching. In this case, the flat part together with the inlay and the protective element is cut from the strip. A partial cutting, as already discussed above, is likewise possible. The punched flat part can then be coated with the metal by means of an electroplating coating process or also other coating processes such as dip-coating, powder-coating and the like. The protective element prevents part of the inlay from being provided with the metal coating. In a final production process, the protective element can be removed from the inlay, whereupon the inlay is freely accessible in the region of the protective element and the flat part and the inlay are coated with the metal in all other regions. As a result, all interfaces between the flat part and the inlay are coated with metal and protected against corrosion.

The subject matter will be explained in more detail below with reference to a drawing which shows examples of embodiments.

Figure 1:
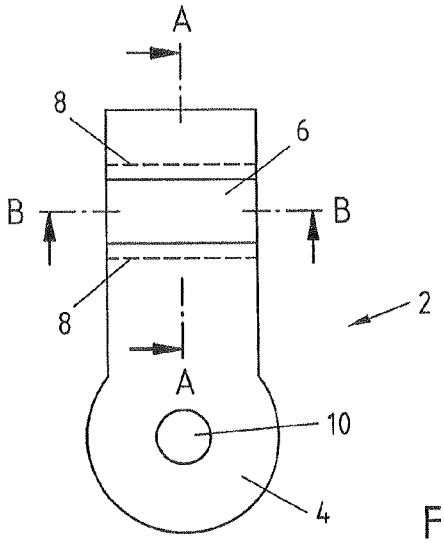
FIG. 1 shows a plan view of a motor vehicle conductor connection element.

FIG. 1 shows a motor vehicle conductor connection element 2 which is formed of a flat part 4 and an inlay 6. The motor vehicle conductor connection element 2 is substantially coated with a metal coating. In particular, the motor vehicle conductor connection element 2 is covered with a metal coating at the interface 8 between the flat part 4 and the inlay 6.

It can furthermore be seen that the motor vehicle conductor connection element 2 has in the region of the flat part 4 a bore 10 for receiving for example a screw or a bolt.

Figure 2:
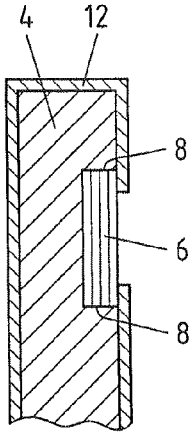
FIG. 2 shows a sectional view of a motor vehicle conductor connection element.

FIG. 2 shows a sectional view A-A through the motor vehicle conductor connection element 2. It can be seen that the inlay 6 is arranged flush with the flat part 4 in the region of the upper surface of the flat part 4. The inlay 6 may be connected to the flat part 4 with a material and/or force and/or form fit. The inlay may have a thickness of from a few μm to a few mm. The flat part 4 is coated with a metal coating 12 in the region of the interface 8 and in all other regions. The inlay 6 is coated only partially with the metal coating 12, namely in the region of the interface 8. The inlay 6 is uncoated in a central region. The thickness of the coating 12 is to be understood as being purely schematic. A coating 12 is preferably applied by means of an electroplating coating process and has a thickness of for example a few micrometers. A plurality of layers made from different materials may also be applied.

By virtue of the coating 12, the interface 8 between the inlay 6 and the flat part 4 is protected against environmental influences. Water cannot penetrate into the interface 8, as a result of which the interface is less susceptible to weathering.

Figure 3:
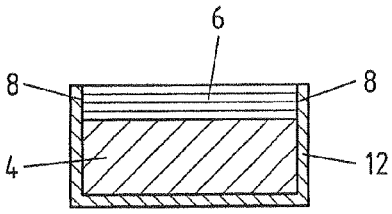
FIG. 3 shows a further sectional view of a motor vehicle conductor connection element.

In order also to prevent the interface 8 from being exposed to environmental influences in the lateral region, the flat part 4 is also coated laterally with the metal coating 12 in the region of the interface 8, as can be seen in FIG. 3 which shows the section B-B.

The motor vehicle conductor connection element 2 is suitable for connecting a cable made for example from aluminium to a cable made for example from copper. By way of example, it is possible that the aluminium cable is connected to the inlay 6 by means of suitable material-to-material connection processes, such as ultrasonic welding, friction welding, rotary friction welding, multi-orbital friction welding, soldering or the like, in the region of the inlay 6 that is free of metal coating. A copper cable can be connected to the flat part 4, which may likewise be formed of aluminium, also by means of material-to-material connection processes. A screwing or soldering of the copper cable, which may be a flat cable, is also possible. It is pointed out that it is also possible that the inlay is formed of copper and the flat part is formed of aluminium. In this case, the inlay serves for contacting a copper cable, for example by means of material-to-material connection processes such as welding or soldering. The flat part made from aluminium can be used for contacting with an aluminium flat conductor.

Figure 4:
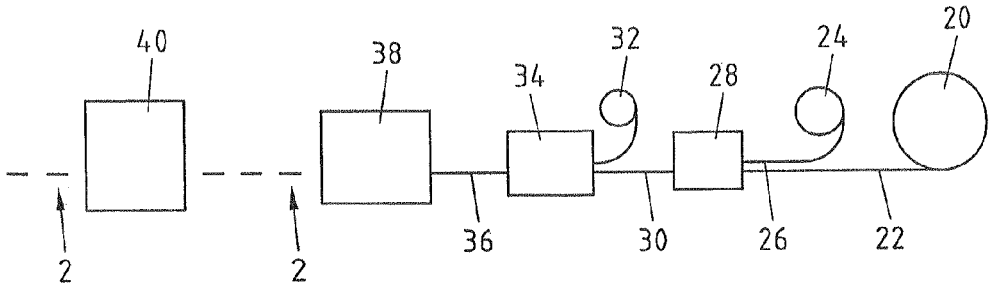
FIG. 4 shows a schematic diagram of a production method.

A simple production of a motor vehicle conductor connection element 2, as shown in FIGS. 1-3, is shown schematically in FIG. 4. A strip 22, which is made for example from copper, brass, bronze or other non-ferrous metals or alloys thereof, is unwound from a coil 20. In addition, a somewhat thinner material made from the material of the inlay is unwound from a coil 24 along the longitudinal axis of the strip 22 and positioned on the strip 22. By means of a roller 28, the strip 26 is connected to the strip 22 in such a way that the two strips are flush in the region of the surface. Instead of the roller 28, other connection processes may also be used. It is also possible that a strip that has already been plated is unwound. The plated strip may be for example a copper strip with an aluminium plating serving as the inlay.

The resulting strip 30, which is formed of the strip 22 and the strip 26 and essentially has an inlay made from the material of the strip 26, is connected in a further processing step to an unwound protective element 32 in a connection step 34. The protective element may be for example a film-like element which is adhesively bonded onto the strip 30. The protective element 32 need not necessarily be a film-like element, but rather may also be a stopper, for example made from rubber, a varnish or some other covering. It is also possible that the covering is merely pressed onto the strip during the subsequent coating process.

The resulting strip 36 is partially covered with the protective element 32 in the region of the inlay. The strip is then cut into individual motor vehicle conductor connection elements 2 in a punching process 38. During the punching operation, both the external shape and a bore 10 May be provided for example. During the punching operation, 38, the motor vehicle conductor connection element 2 need not necessarily be completely cut from the strip 36. It is also possible that the motor vehicle conductor connection element 2 is cut from the strip 36 along three sides and is only partially cut along a fourth side, with a connecting web to the strip nevertheless remaining. This connecting web may have for example a predetermined breaking point. The strip 36 thus carries the substantially punched-out motor vehicle conductor connection elements 2 in the manner of a strap.

During the punching operation 38, a region of the flat part may also be formed as an insulation crimp. It is thus possible for example that outwardly pointing lugs are provided on two opposite sides of the flat part, said lugs being formed from the strip 36 during the punching operation. In the same processing step, these lugs can be bent out of the plane of the flat part. These lugs can then serve as crimping elements which can be used for crimping the insulation of the conductor connected to the inlay.

The connection step 34 may also take place after the punching 38 and the formation of the insulating crimps.

The loose materials or the strap which has been produced after the punching process 28 may be coated with a metal, for example zinc, tin or alloys thereof, in an electroplating coating process 40 using suitable methods. Up to this point in time, the protective element 32 is still located on the motor vehicle conductor connection elements 2. This prevents the covered region of the inlay from being coated with metal during the metal coating operation.

The resulting motor vehicle conductor connection elements 3 are thus completely coated with metal, with just cart of the inlay being protected by the protective element 32 and not being coated with metal. The protective element can then be removed (not shown), whereupon a motor vehicle conductor connection element 2 as shown in FIG. 1 is obtained.

It is also possible to carry out the processing step involving the punching 28 at the start of processing, particularly when, as described above, the strip is still at least partially connected as a strap to the motor vehicle conductor connection element 2 after the punching. A protective element can then be applied in a step 34 to this strap of the strip and partially punched-out motor vehicle conductor connection elements 2. The strip 36 can then be coated together with the protective element 32 in a coating process 40. The strip 36 can then be separated from the protective element 32 in an endless process. Finally, the motor vehicle conductor connection element 2 can be completely cut from the strip 36.

Figure 5:
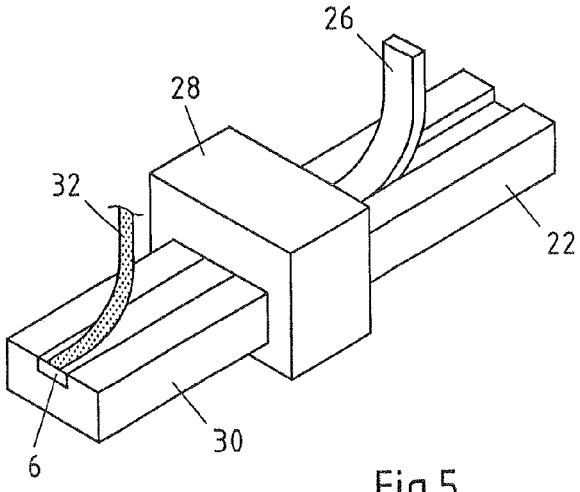
FIG. 5 shows a view of a production method.

The step of rolling 28 and of applying the protective element 32 is shown schematically once more in FIG. 5. The strip 22 is fed together with the strip 26 to a roller 28. The result of the rolling process is a strip 30 in which the inlay 6 is substantially flush with the surface of the strip 30 and extends in the longitudinal direction of the strip 30. Thereafter, a region of the inlay 6 is covered by means of a protective element 32. The protective element 32 prevents the metal coating from coating the entire inlay 6 in a subsequent electroplating process. Once the protective element 32 has been removed after the coating step, a region of the inlay 6 is free of metal coating and is suitable for electrical contacting, for example by means of material-to-material connection technology.

A contacting between electrical energy conductors made from different metals can be achieved inexpensively with the aid of the illustrated motor vehicle conductor connection element and the illustrated method.

The invention claimed is:

1. A motor vehicle conductor connection element comprising:

a flat part;

an inlay arranged in the flat part so as to provide an inlay surface substantially flush with a surface of the flat part, wherein the flat part and the inlay are made from different metals and a material-to-material interface forms between the material of the inlay and the material of the flat part;

a metal coating substantially coating the surface of the flat part and extending over the interface and onto the inlay surface so as to partially coat the inlay with the metal in the region of the interface, wherein the inlay is free of the metal coating in a central region remote from the interface.

2. The motor vehicle conductor connection element according to claim 1, wherein the flat part is formed substantially of aluminum or alloys thereof and the inlay is formed of a non-ferrous metal or alloys thereof.

3. The motor vehicle conductor connection element according to claim 2, wherein the inlay is formed of one of copper, zinc, tin, bronze and brass.

4. The motor vehicle conductor connection element according to claim 1, wherein the flat part is formed substantially of a non-ferrous metal or alloys thereof and the inlay is formed of aluminum or alloys thereof.

5. The motor vehicle conductor connection element according to claim 4, wherein the flat part is one of copper, zinc, tin, bronze and brass.

6. The motor vehicle conductor connection element according to claim 1, wherein the inlay is arranged in a groove of the flat part.

7. The motor vehicle conductor connection element according to claim 1, wherein the inlay is pressed or rolled into the flat part.

8. The motor vehicle conductor connection element according to claim 1, wherein the flat part is produced from a first strip extending in a longitudinal direction with the inlay produced from a second strip arranged in the longitudinal direction.

9. The motor vehicle conductor connection element according to claim 8, wherein the flat part together with the inlay is at least partially punched from the first strip.

10. The motor vehicle conductor connection element according to claim 1, wherein the flat part together with the inlay forms a connecting lug.

11. The motor vehicle conductor connection element according to claim 10, wherein the connecting lug has a connection for a bolt.

12. A method for producing a vehicle conductor connection element comprising:

providing a strip with an inlay extending flush with the surface of the strip along the longitudinal axis of the strip;

cutting a flat part from the strip together with the inlay, wherein the flat part and the inlay are made from different metals and an interface forms between the material of the inlay and the material of the flat part;

substantially coating the flat part with a metal; and partially coating the inlay with the metal, such that the inlay is coated with the metal in the region of the interface with the flat part, and the inlay is free of the metal coating in a central region remote from the interface with the flat part.

13. The method according to claim 12, wherein the inlay is first covered at least partially with a protective element and then the flat part is coated with the metal.

14. The method according to claim 13, wherein the inlay on the strip is covered with the protective element and the flat part is then at least partially cut from the strip.

15. The motor vehicle conductor connection element according to claim 1, wherein the flat part is completely coated with the metal.

16. The method according to claim 12, wherein the flat part is completely coated with the metal.

* * * * *